US008365440B2

(12) United States Patent
Rivas et al.

(10) Patent No.: US 8,365,440 B2
(45) Date of Patent: Feb. 5, 2013

(54) SUPPORTING PLATE APPARATUS FOR SHOES

(75) Inventors: Jake Rivas, Oakland, CA (US); Barry McGeough, Santa Barbara, CA (US)

(73) Assignee: The North Face Apparel Corp., Wilmington, DE (US)

( * ) Notice: Subject to any disclaimer, the term of this patent is extended or adjusted under 35 U.S.C. 154(b) by 1003 days.

(21) Appl. No.: 12/122,563

(22) Filed: May 16, 2008

(65) Prior Publication Data

US 2008/0289220 A1 Nov. 27, 2008

Related U.S. Application Data

(60) Provisional application No. 60/938,943, filed on May 18, 2007.

(51) Int. Cl.
*A43B 13/12* (2006.01)
*A43B 7/14* (2006.01)

(52) U.S. Cl. ..... 36/30 R; 36/107; 36/88

(58) Field of Classification Search ..... 36/88, 69, 36/30 R, 76 R, 107, 108, 75 R, 91, 73
See application file for complete search history.

(56) References Cited

U.S. PATENT DOCUMENTS 4,947,560 A * 8/1990 Fuerst et al. ..... 36/88
6,321,469 B1 * 11/2001 Cretinon ..... 36/102
6,497,058 B2 12/2002 Dietrich et al.
6,817,112 B2 * 11/2004 Berger et al. ..... 36/3 B
7,082,702 B2 * 8/2006 Cretinon ..... 36/88
7,299,567 B2 * 11/2007 Berend et al. ..... 36/88
7,421,805 B2 * 9/2008 Geer ..... 36/25 R
7,647,709 B2 * 1/2010 Reilly et al. ..... 36/30 R
2004/0111920 A1 * 6/2004 Cretinon ..... 36/30 R
2005/0034328 A1 * 2/2005 Geer ..... 36/30 R
2005/0268491 A1 * 12/2005 McDonald et al. ..... 36/28
2006/0277798 A1 12/2006 Reilly et al.

FOREIGN PATENT DOCUMENTS

JP 02-036801 A 2/1990
JP 2003-009906 A 1/2003

* cited by examiner

*Primary Examiner* — Jila M Mohandesi
(74) *Attorney, Agent, or Firm* — Kenyon & Kenyon LLP

(57) ABSTRACT

One aspect of the present invention is directed to an article of footwear including a snake-shaped foot plate that prevents "penetration," when concentrated stresses are transmitted to cause discomfort to the wearer, of intermediate sized rocks through a shoe. Specifically the snake-shaped plate embodiments with plurality of longitudinally staggered, substantially lateral cutouts enable increased torsional flexibility and distribute the stresses towards the outer parts of the shoe. The plate insert can include a plurality of longitudinally staggered cutouts extending substantially laterally from the central longitudinal axis forming a plurality of outriggers such that the cutouts on the left side are not located directly opposite from the cutouts on the right side. The cutouts can be straight or curved and the endpoints can be laterally aligned or not.

30 Claims, 12 Drawing Sheets

1200

1300

SUPPORTING PLATE APPARATUS FOR SHOES

CROSS-REFERENCE TO RELATED APPLICATIONS

The present application claims the benefit of priority to provisional application Ser. No. 60/938,943, filed May 18, 2007, the disclosure of which is incorporated herein by reference in its entirety.

BACKGROUND OF THE INVENTION

A. Field of the Invention

Aspects of the present invention relate generally to footwear. More particularly, the present invention relates to the use of a flexible plate as a support apparatus in an item of footwear.

B. Description of the Related Art

A major consideration in designing active footwear is hazards (e.g., stones and rocks). Stepping on stones, rocks or other small irregularities (hereinafter "rocks") can concentrate forces on the shoe sole in a small area, thereby increasing pressure or stress in the area. A stone or rock is said to "penetrate" the sole when concentrated stresses are transmitted to cause discomfort to the wearer.

The extent of stress placed on a piece of footwear, and the associated risk of penetration, may be dependent on the size of the rock (i.e., small, medium, large etc.). Small rocks typically cause only limited concentrated stresses in a localized region of the sole of a shoe. See e.g., FIG. 1. Usually, these concentrated stresses are easily dissipated by using cushioning material in the shoe sole. Larger rocks also typically present lesser risk of penetration because larger rocks offer larger contact areas. See e.g. FIG. 2. Larger contact areas allow for a greater distribution (i.e., less concentration) of internal stresses created by contact, thereby minimizing risk of penetration.

Rocks of intermediate size, however, typically present the greatest risk of penetration. See e.g., FIG. 3. Stresses generated by intermediate rocks are typically concentrated enough to cause pain to the user. Rocks of intermediate size are those ranging from 1-6 centimeters.

Rock penetration is primarily a forefoot issue. The heel is typically protected by both a thicker cushion in the heel of a shoe, and a thick, fat pad of flesh located under the heel of the wearer. This multilayered cushion typically provides more than adequate protection against rock penetration, and serves to dissipate forces or stresses caused by contact. However, in the forefoot, hard tissues (e.g., bones) are closer to the ground surface, and less protected by cushioning soft tissue. Moreover, current shoe designs often require the shoe sole to be thinner in the forefoot, and therefore are less resistant to rock penetration.

Referring to FIG. 4, an exemplary shoe construction is shown. Boot 110 includes an outsole 112, midsole 114, shank 116, and shell 118. Heel cushion 120 and forefoot cushion 122 may be disposed between an insole 124 and shell 118. An upper 126 also may be provided, and optionally may include lacing 128. Preferably, shank 116 is disposed in a recess 114*a* in midsole 114, while cushions 120, 122 are disposed in recesses in insole 124.

In an exemplary embodiment, outsole 112 may be formed of carbon rubber, while midsole 114 may be formed of molded ethyl vinyl acetate foam. Shank 116 may be formed of thermoplastic polyurethane, while upper 126 may be formed of leather, fabric textiles, foam and other suitable insulation.

Various polymer components may be coupled to each other with an adhesive or other bonding agent, while upper 126 may be coupled to shell 118, for example, using stitching proximate to the lower edge of leather portion 130 of upper 126.

A stiff plate may be inserted in the shoe to resist rock penetration. A plate presents a physical barrier to the rock, reducing the extent to which it compresses and penetrates the midsole. It further acts as a buffering conduit by redistributing concentrated stresses, thereby reducing internal stress in the sole materials and peak pressures acting on the foot.

The effectiveness of a plate design may be measured through various performance parameters. These performance parameters include flexibility, torsional flexibility/resistance, uniformity, weight, and stability. Flexibility may be measured by, among other things, the stiffness of the plate during bending. Torsional flexibility/resistance may be determined by, among other things, the stiffness of the plate during bending along the longitudinal axis of the plate. Uniformity typically refers to the ability of the plate to distribute the stresses incurred evenly across its body. Stability typically refers to the difference in stiffness between the medial/lateral and the central portions of the shoe.

In many instances, it may be desirable to provide a supportive, cushioning, rock-resistant plate design wherein the aforementioned criteria are optimized.

DETAILED DESCRIPTION OF THE DRAWINGS

Figure 1:
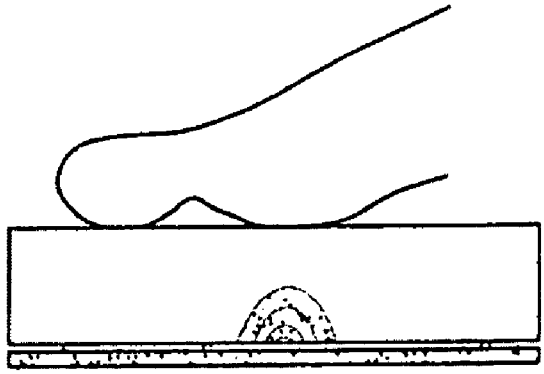
FIG. 1 illustrates an example of the effect of rocks of small radius on the plantar surface of the foot.
Figure 2:
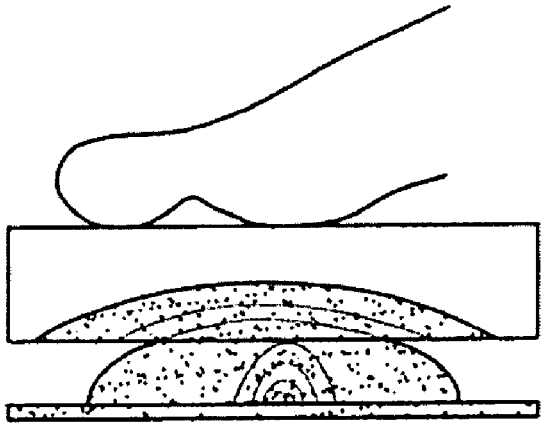
FIG. 2 illustrates an example of the effect of rocks of large radius on the plantar surface of the foot.
Figure 3:
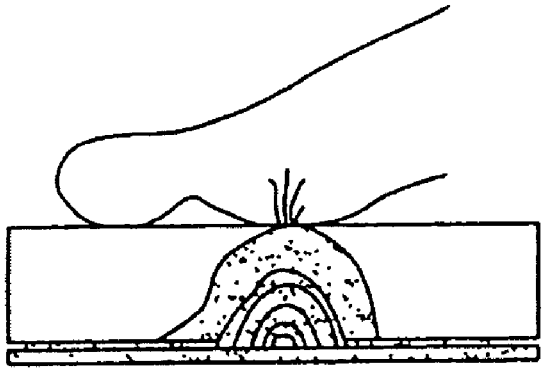
FIG. 3 illustrates an example of the effect of rocks of medium radius on the plantar surface of the foot.
Figure 4:
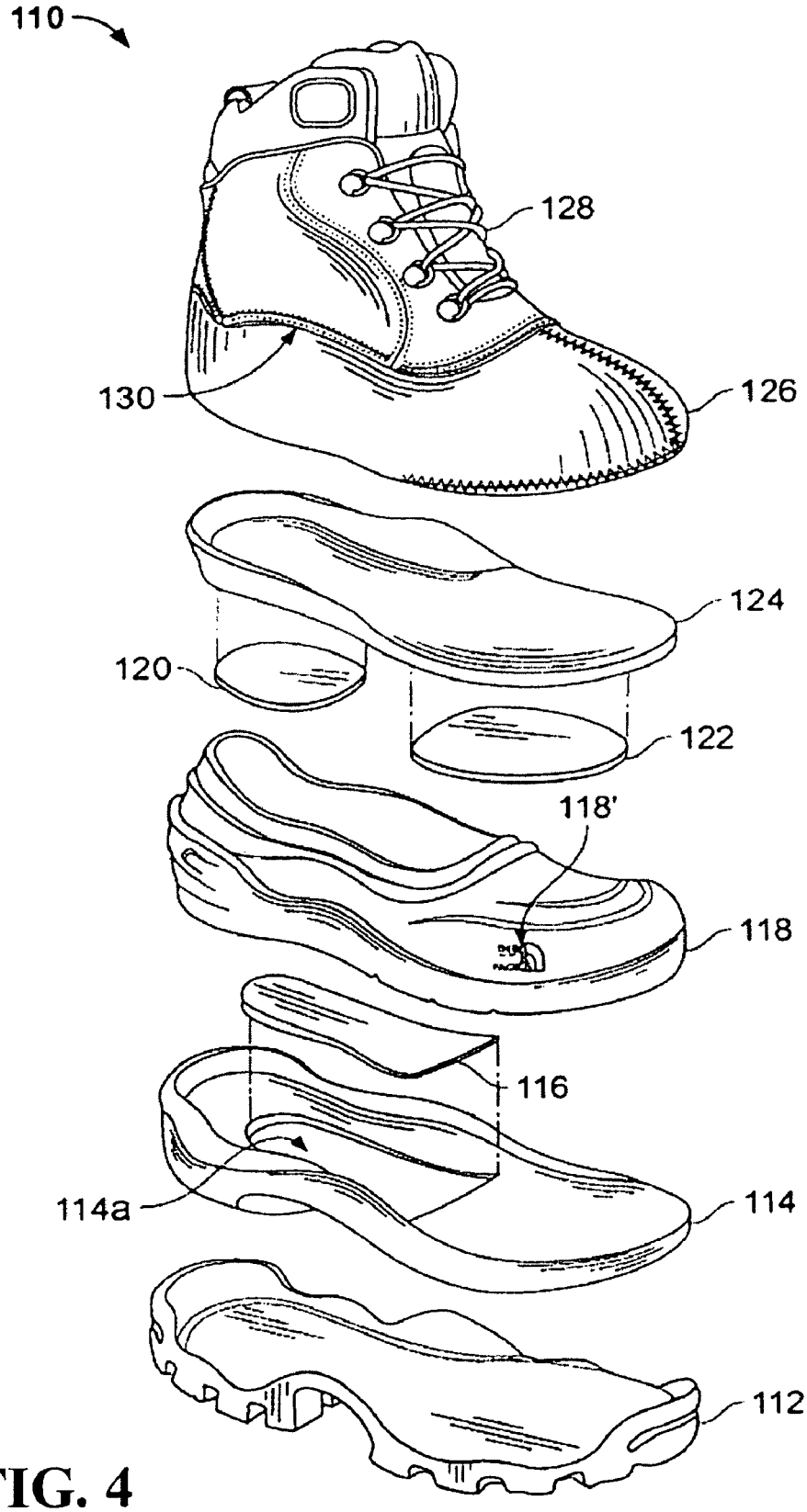
FIG. 4 (Prior Art)
FIG. 4 provides an example of an illustration of a conventional shoe construction.

Detailed descriptions of one or more embodiments of the invention follow, examples of which may be graphically illustrated in the drawings. Each example and embodiment are provided by way of explanation of the invention, and not meant as a limitation of the invention. For example, features described as part of one embodiment may be utilized with another embodiment to yield still a further embodiment. It is intended that the present invention include these and other modifications and variations.

Figure 5:
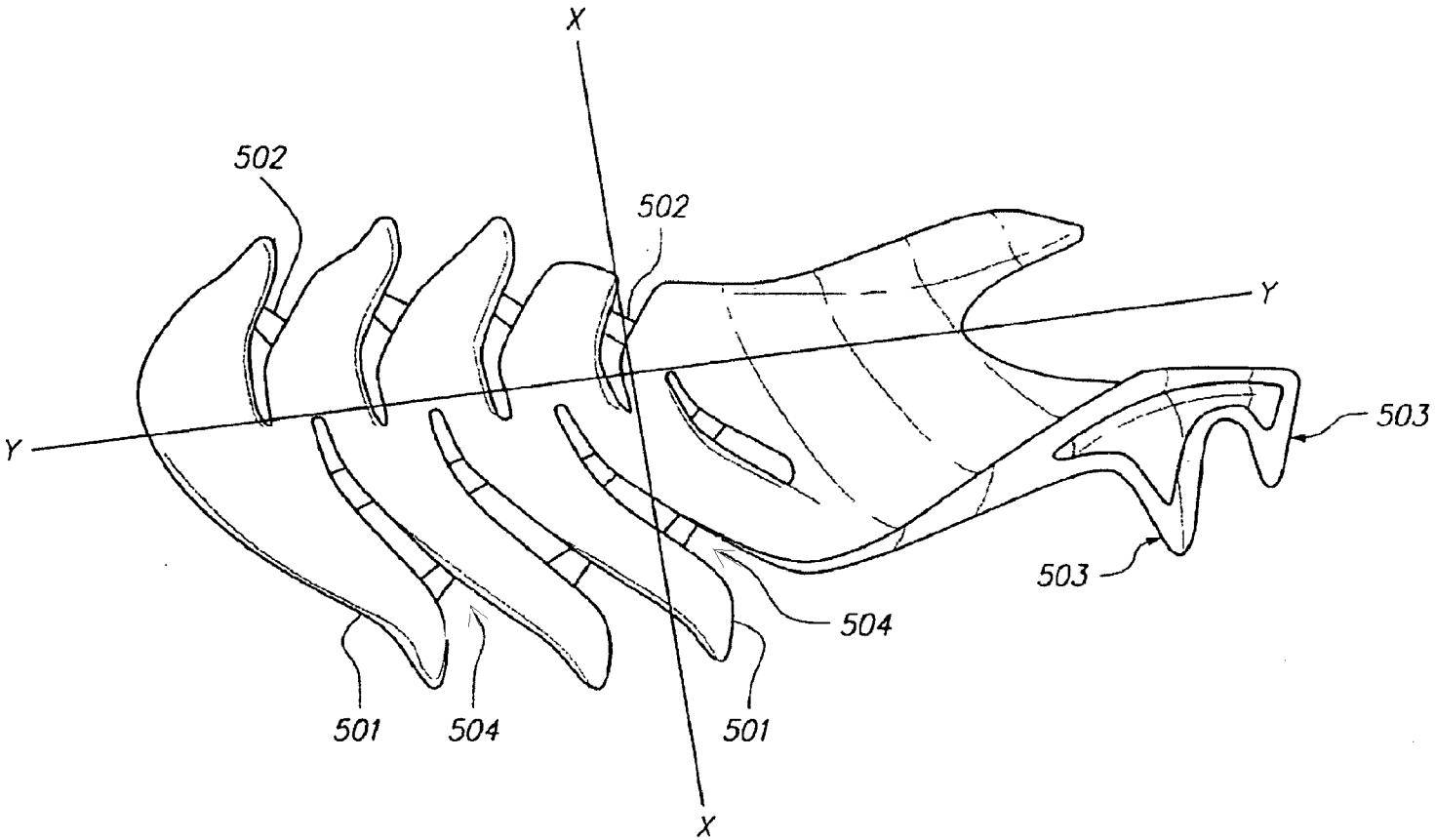
FIG. 5 provides an illustration of an exemplary snake-shaped foot plate embodiment.

FIG. 5 illustrates a foot plate embodiment. The foot plate can include a plurality of longitudinally staggered, substantially lateral cutouts that amount to a returning, back-and-forth plate structure as shown. The longitudinal axis is shown by line Y-Y, while the lateral axis is shown by line X-X. This "snake" or continuous "S" (or "Z") shape allows full torsional flexibility, while reducing compression and protecting from penetration.

In certain embodiments, the "snake" shape may redistribute concentrated external stresses along extensions or outriggers 501. Outriggers 501 may be formed by longitudinally staggered, substantially lateral cutouts 504. In effect, the snake shape formed by outriggers 501 may aid in distributing stresses toward outer parts of the shoe. This may reduce internal stress in shoe sole materials above the plate, and alleviate pressure on the foot. Embodiments of the snake-shaped foot plate may also include support ribs 502 to further aid in stress dissipation, and postings 503 to support and enclose the user's foot.

Snake-shaped embodiments enable increased torsional flexibility. In these embodiments, the snake-shape may offer less resistance to forces placed along the longitudinal axis. This allows an athlete faced with hazards to more effectively utilize "give" along the longitudinal axis and maintain balance during use.

Furthermore, the snake-shape of the instant exemplary embodiment the plate may aid in providing maximum flexibility along the horizontal axis of the plate. The snake-shape may allow a plate to bend more willingly from heel-to-toe, which is of great benefit to those users supporting their weight on their heels, and may aid the wearer in maintaining or regaining her balance.

Embodiment snake-shaped foot plates as described herein may be optimized to provide these benefits while still remaining lightweight. Specifically, when compared to a typical solid plate, an embodiment foot snake-shaped plate as described herein may be stripped of as much unnecessary material as possible, while still providing the benefits described above.

Embodiments of the snake-shaped foot plate may be composed of a single piece of elastomeric polymer (e.g., Hytrel, Pebax, TPU, TPO) or composite material (e.g., carbon fiber, TPU composite), and may be shaped as a curving snake or several continuous snake-shapes (as described above).

Figure 6:
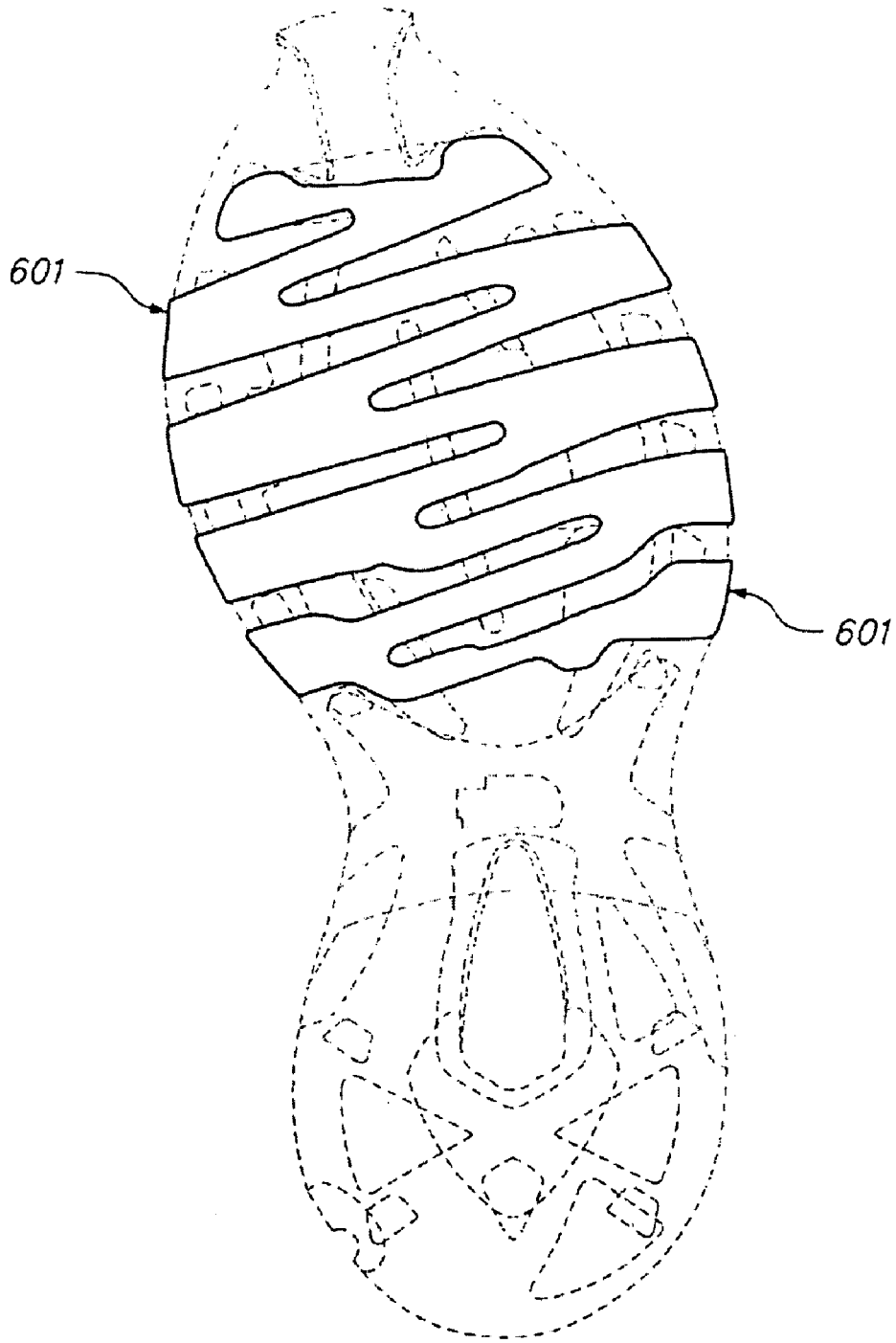
FIG. 6 provides an illustration of an exemplary snake-shaped foot plate embodiment.

In certain embodiments, the snake-shaped foot plate may extend along the foot, while in others it may extend from the toe area to the midfoot area. See e.g., FIG. 6. The snake-shaped foot plate embodiment illustrated in FIG. 6 includes extensions or outriggers 601.

Snake-shaped foot plate embodiments may be located near the top, bottom, or middle of the midsole, with cushioning material placed above and below the plate.

In certain embodiments, outriggers may extend to the horizontal edges of the shoe, while in others it may extend substantially but not completely to the horizontal edges.

In certain embodiments, outriggers may be substantially similar lateral width. See e.g., FIG. 5. In other embodiments, outriggers may be tapered (toward the midfoot or the toe) to fit the general design of the shoe. See e.g., FIG. 6.

Snake-shaped foot plate embodiments extending from the toe area to the midfoot may be especially effective for athletes who balance their weight on their toes (e.g., uphill runners). Uphill runners, for example, require maximum torsional flexibility for at least two reasons. First, the runner's body weight is supported in a very small area (i.e., the toe region). As such, the runner requires the maximum amount of flexibility to help maintain balance and support her constantly-moving body weight. Second, any stone penetration in this relatively small area can knock the runner off-balance. Snake-shaped foot plate embodiments extending from the toe area may aid in dissipating these concentrated stresses in the toe area.

In one embodiment, the distance between the midpoint of one outrigger of the snake-shaped foot plate to the next may be between 0.5 mm-20.0 mm.

Figure 7:
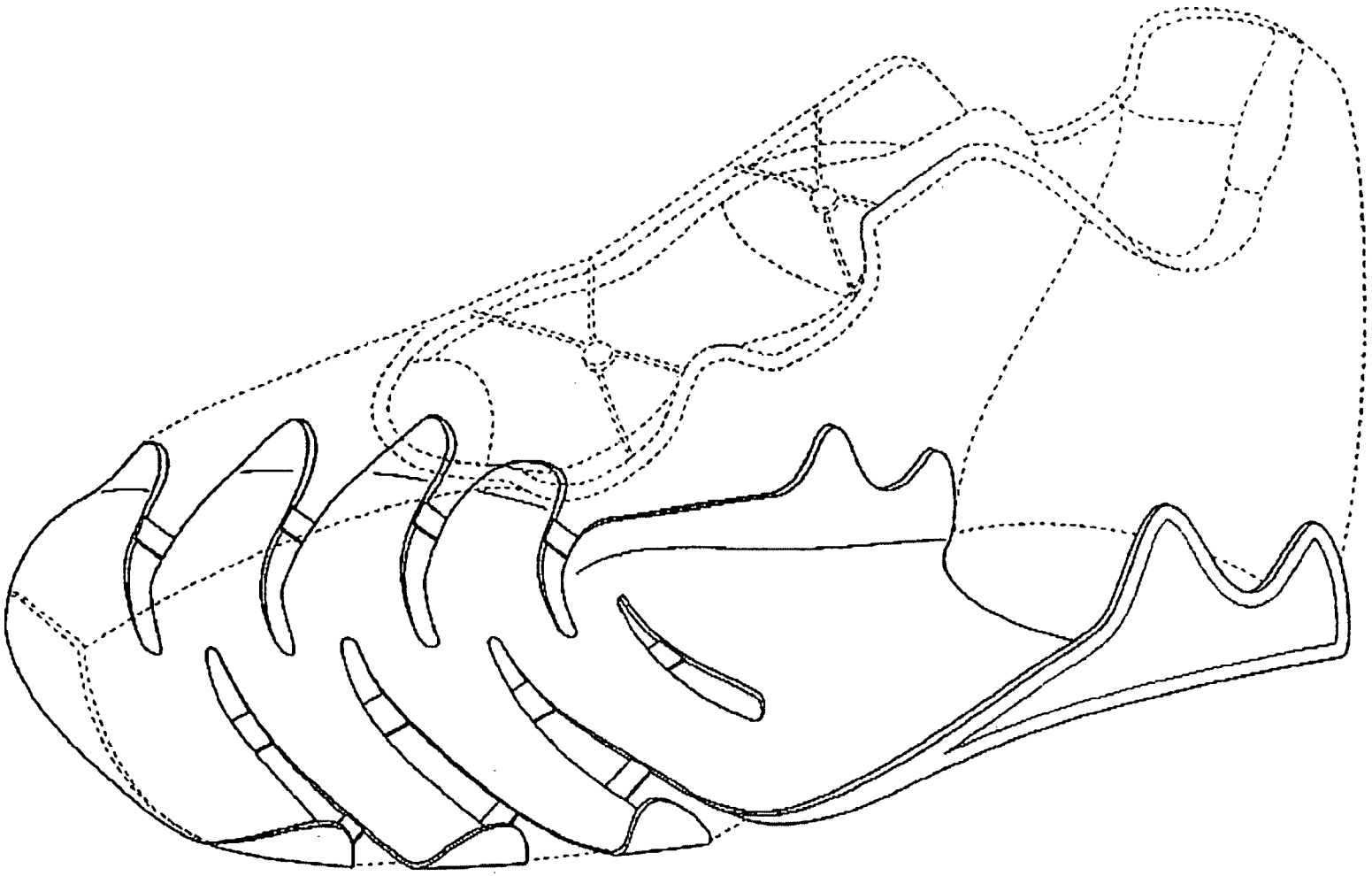
FIG. 7 provides an illustration of an exemplary snake-shaped foot plate embodiment in perspective view.
Figure 8:
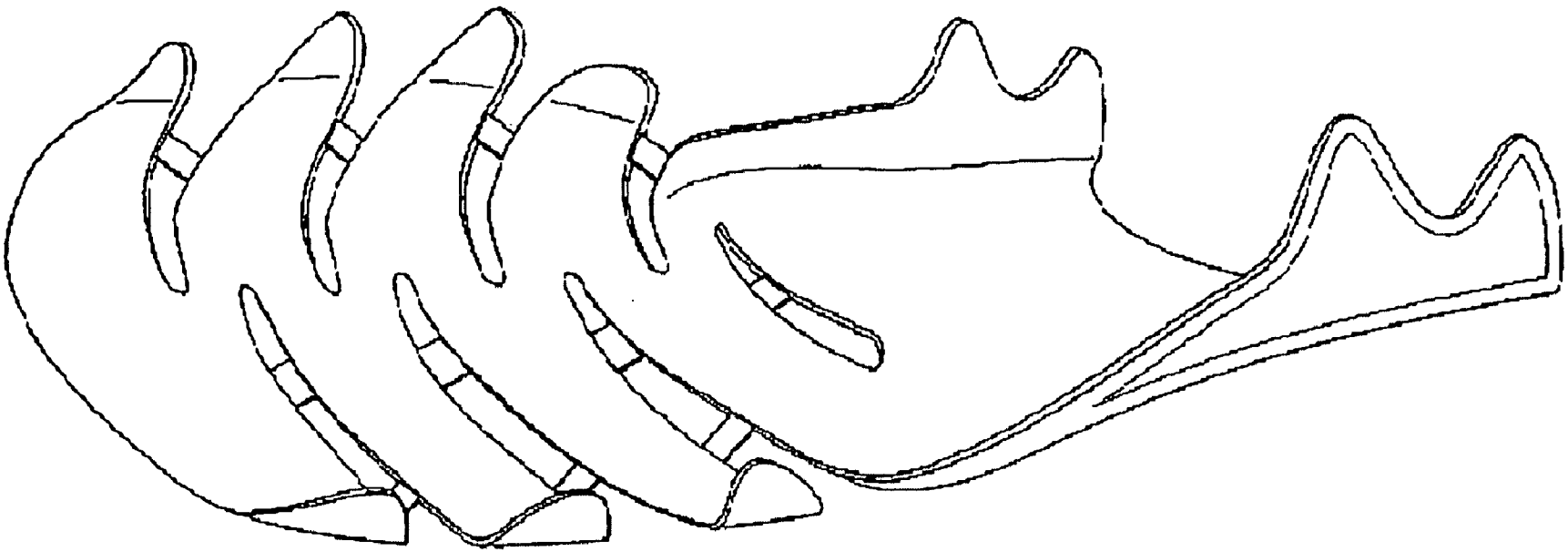
FIG. 8 provides an illustration of an exemplary snake-shaped foot plate embodiment in perspective view.
Figure 9:
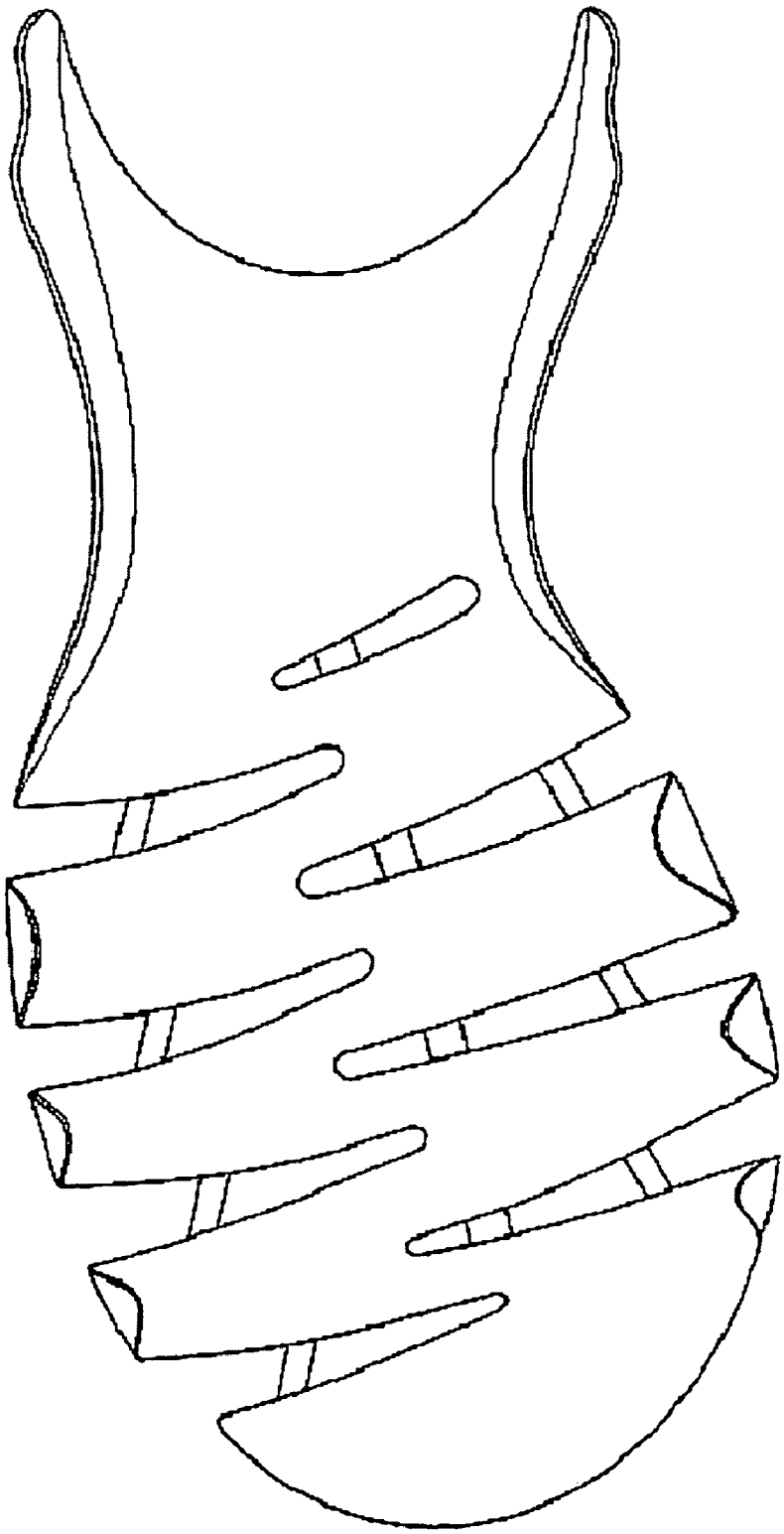
FIG. 9 provides an illustration of an exemplary snake-shaped foot plate embodiment in top view.
Figure 10:
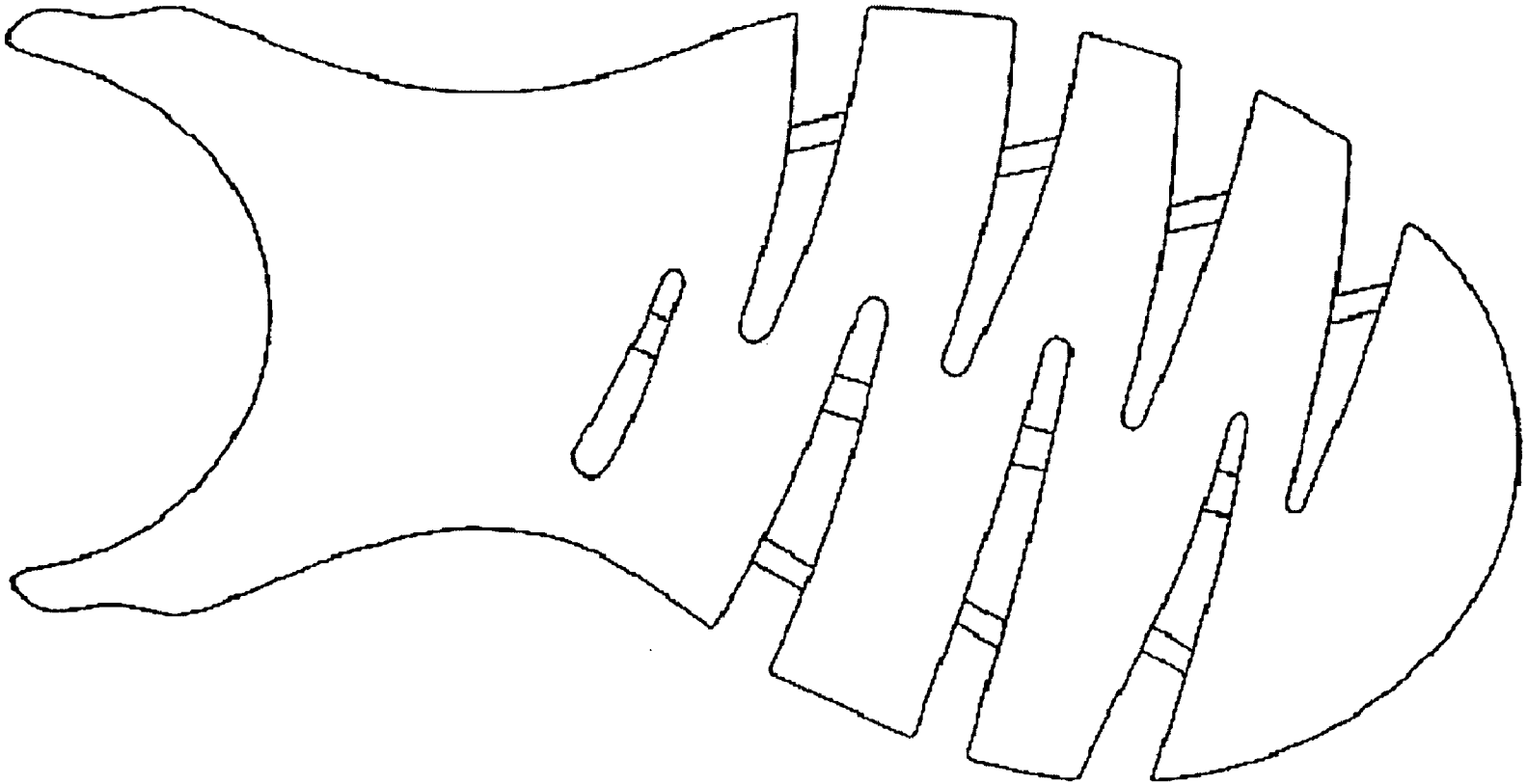
FIG. 10 provides an illustration of an exemplary snake-shaped foot plate embodiment in bottom view.
Figure 11:
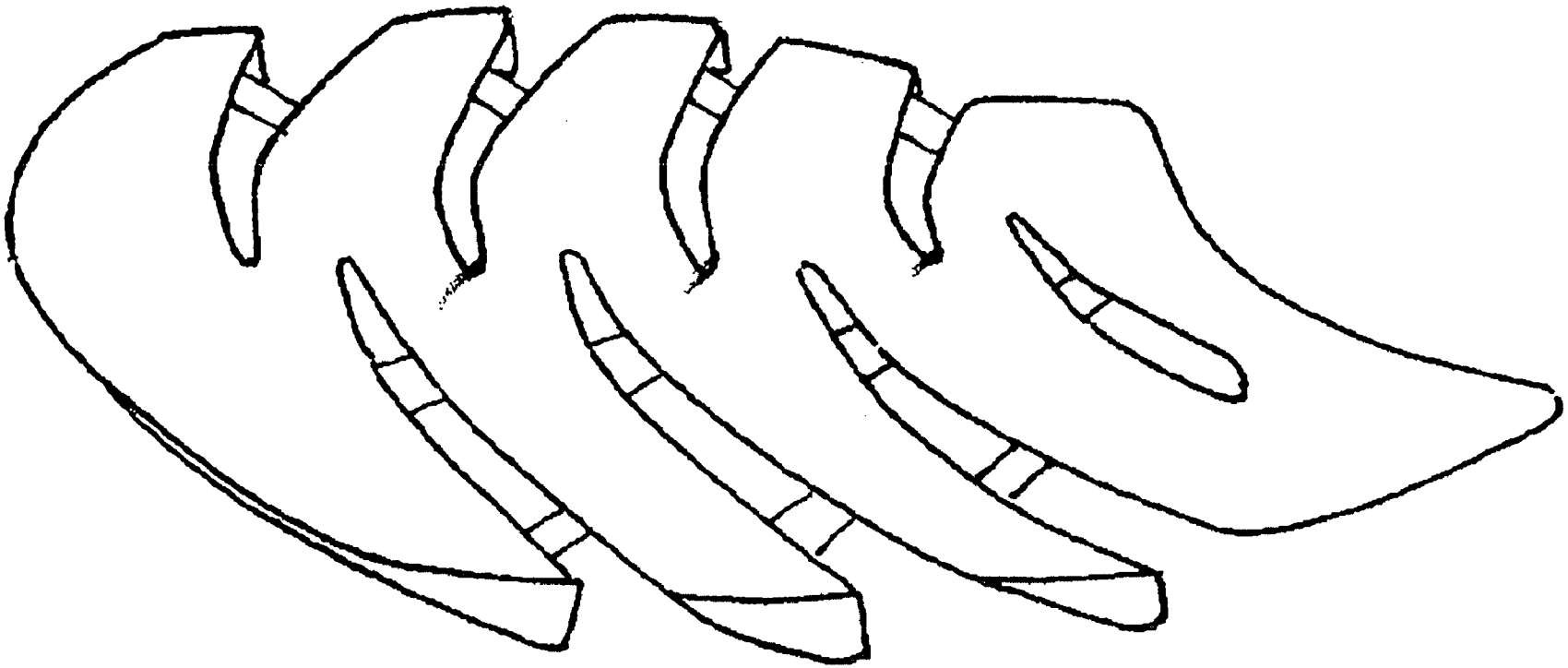
FIG. 11 provides an illustration of an exemplary snake-shaped foot plate embodiment.

FIGS. 7-11 illustrate several views of snake-shaped foot plate embodiments. FIG. 7 illustrates an embodiment snake-shaped foot plate in a perspective view as part of an athletic shoe. FIG. 8 illustrates another perspective view of an embodiment snake-shaped foot plate. FIG. 9 illustrates a top view of an embodiment snake-shaped foot plate. FIG. 10 illustrates a bottom view of an embodiment snake-shaped foot plate. FIG. 11 illustrates a view of an embodiment snake-shaped foot plate extending only to the midfoot.

Figure 12:
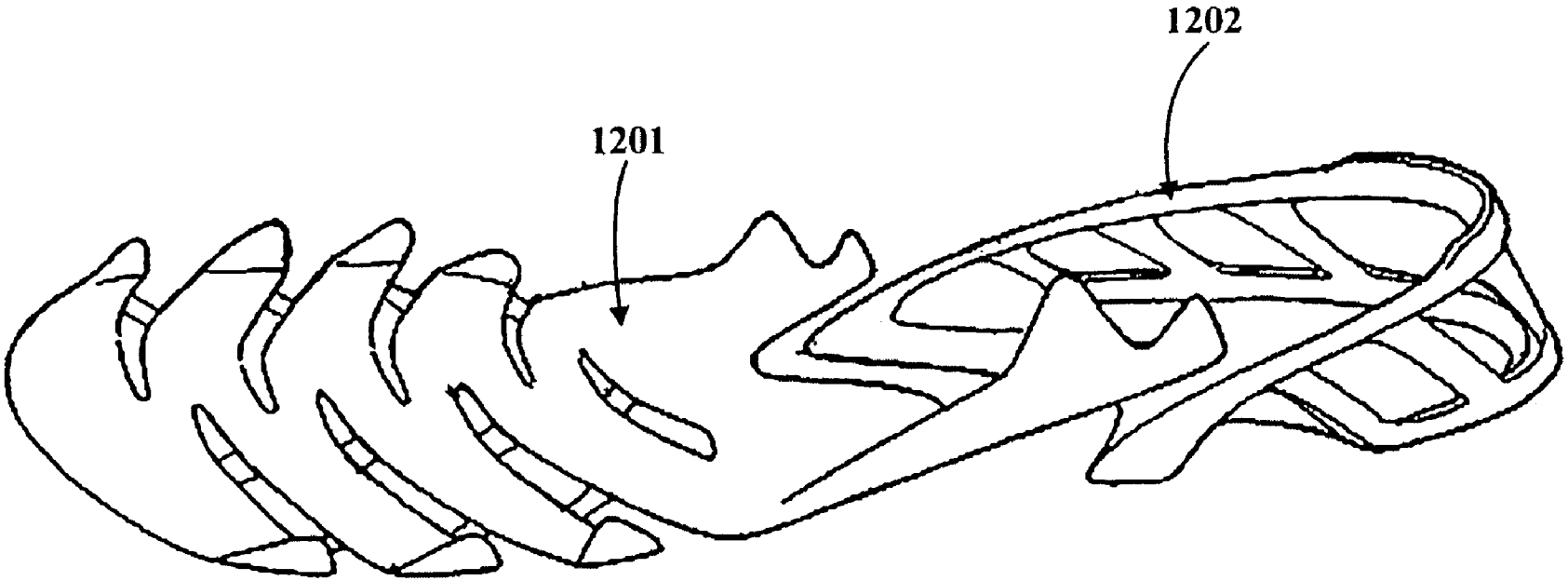
FIG. 12 provides an illustration of an exemplary snake-shaped foot plate embodiment incorporating a reinforcing heel cage.
Figure 13:
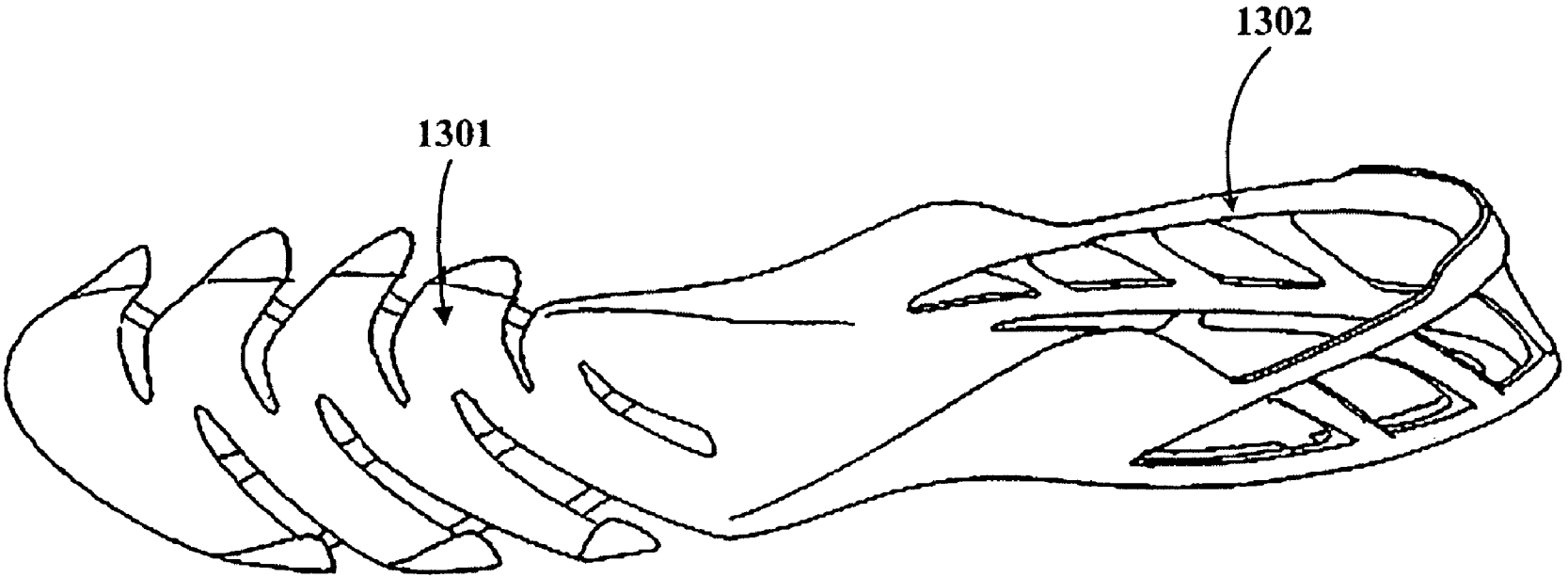
FIG. 13 provides an illustration of an exemplary snake-shaped foot plate embodiment incorporating a reinforcing heel cage.

FIGS. 12-13 provide an illustration of a snake-shaped foot plate embodiment incorporating a reinforcing heel cage. FIG. 12 illustrates sole 1200 including snake-shaped foot plate 1201 separate from reinforcing heel cage 1202 including an upper rim, a lower rim, and connecting ribs to support and encase midsole cushioning materials. FIG. 13 illustrates sole 1300 including snake-shaped foot plate 1301 and reinforcing heel cage 1302 formed continuously together.

Figure 14:
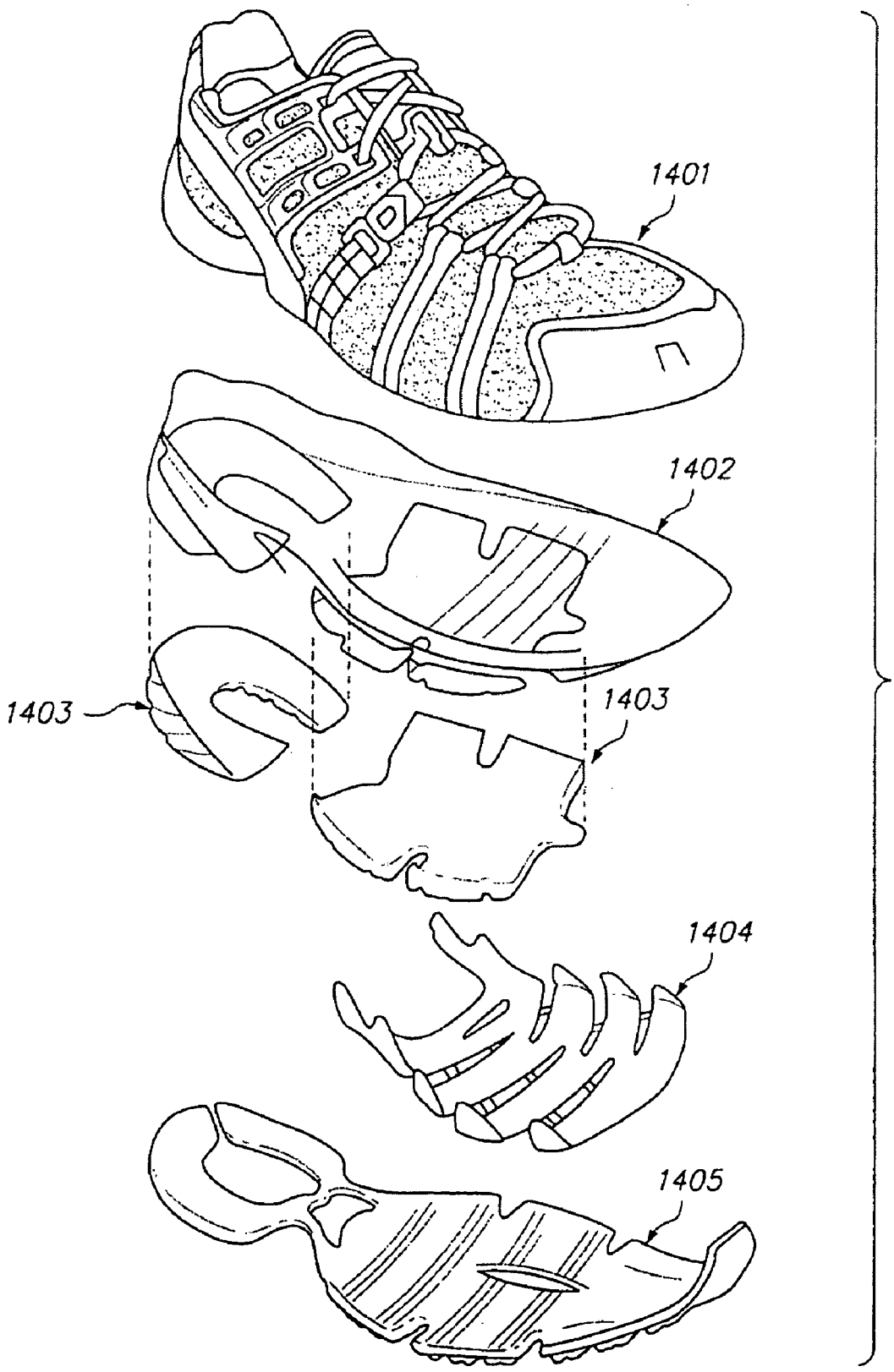
FIG. 14 provides an illustration of an exploded view of a typical running shoe incorporating an exemplary snake-shaped foot plate embodiment.

FIG. 14 provides an illustration of an exploded view of a typical running shoe incorporating a snake-shaped foot plate embodiment. Upper 1401 and outsole 1405 sandwich midsole 1402 and snake-shaped foot plate 1404. Midsole 1402 may further comprise midsole cushions 1403.

While the embodiments of the present invention have been described with reference to the aforementioned applications, this description of the embodiments is not meant to be construed in a limiting sense. It shall be understood that all aspects of the embodiments of the present invention are not limited to the specific depictions, configurations or dimensions set forth herein which depend upon a variety of principles and variables. Various modifications in form and detail of the disclosed apparatus, as well as other variations of the embodiments of the present invention, will be apparent to a person skilled in the art upon reference to the present disclosure.

What is claimed is:

1. An article of footwear having a bottom external surface, a top surface, and a vertical axis extending therebetween; a front end, a back end, and a central longitudinal axis extending therebetween; and an inner side, an outer side, and a lateral axis extending therebetween, said footwear comprising:

a midsole;

an outsole on a bottom external surface of the footwear; and a plate insert disposed along the vertical axis between the midsole and the outsole, comprising:

a plurality of longitudinally staggered cutouts extending substantially laterally, thereby forming a plurality of outriggers, wherein the plurality of outriggers are connected together by a central planar portion, and a plurality of support ribs, at least one support rib extending across each of the plurality of cutouts, wherein the plate insert is not exposed on the bottom external surface of the footwear.

2. The article of footwear of claim 1, wherein the plurality of outriggers are of substantially similar lateral width.

3. The article of footwear of claim 1, wherein the plurality of outriggers are of tapered widths.

4. The article of footwear of claim 1, wherein the plate insert comprises postings at the back heel end extending upwardly to support and enclose a user's foot.

5. The article of footwear of claim 1, wherein the plate insert is composed of a composite of carbon fiber and thermoplastic polyurethane or elastomeric polymer.

6. The article of footwear of claim 1, wherein the width of the plurality of cutouts is between 0.5 mm and 20 mm.

7. The article of footwear of claim 1, wherein none of the plurality of cutouts is directly opposed to another of the plurality of cutouts.

8. The article of footwear of claim 1, wherein the plurality of cutouts are curved and extend substantially rearwardly towards the back heel end.

9. The article of footwear of claim 1, wherein the plate insert is rounded at the front end.

10. The article of footwear of claim 1, wherein the plate insert extends from the front toe end to a midfoot area of a user when in use.

11. The article of footwear of claim 1, wherein the plurality of cutouts comprises: a first cutout forming a first outrigger and a third outrigger, and a second cutout forming a second outrigger and a fourth outrigger.

12. The article of footwear of claim 11, wherein the first cutout is located primarily on a first side of the longitudinal axis at a first distance from the front end, and the second cutout is located primarily on a second side of the longitudinal axis at a second distance from the front end.

13. The article of footwear of claim 1, wherein two support ribs extend across at least some of the plurality of cutouts.

14. The article of footwear of claim 1, wherein the plate insert further comprises a reinforcing heel cage comprising a posting extending upward from the plate and configured to surround at least a portion of the side of a wearer's rearfoot when in use.

15. The article of footwear of claim 1, wherein the plate insert further comprises a rearfoot portion, and the midsole further comprises a midsole rearfoot portion disposed generally coextensively with the rearfoot portion of the plate insert, the midsole rearfoot portion comprising an open channel corresponding to a substantial area of a wearer's heel when in use.

16. An article of footwear having a toe end, a heel end, and a central longitudinal axis extending therebetween; and a first side, a second side, and a lateral axis extending therebetween, said footwear comprising:

an upper;

a midsole coupled to said upper;

a reinforcing heel cage coupled to said midsole; and a plate insert disposed between the midsole and the outsole, comprising:

a plurality of longitudinally staggered cutouts extending substantially laterally, thereby forming a plurality of outriggers, wherein the plurality of outriggers are connected together by a central planar portion, and a plurality of support ribs, wherein at least two support ribs extend across each of the plurality of cutouts on the first side.

17. The article of footwear of claim 16, wherein the plate insert is not exposed on an external surface of the footwear.

18. The article of footwear of claim 16, wherein the plurality of cutouts are substantially straight.

19. The article of footwear of claim 16, wherein the plurality of cutouts comprises: a first cutout extending from the first side to a first endpoint, a second cutout extending from the second side to a second endpoint, wherein the first endpoint is laterally spaced from the second endpoint.

20. The article of footwear of claim 16, wherein at least one support rib extends across each of the plurality of cutouts.

21. A plate insert for an article of footwear, comprising:

a plurality of cutouts extending substantially transversely to a longitudinal axis of the plate defining at least three adjacent, transversely-extending, elongate elements, the elongate elements having endpoints adapted to be disposed towards a lateral side and a medial side of a user's foot, wherein the elongate elements are connected together by a central planar portion, wherein each adjacent elongate element is interconnected to another adjacent elongate element by at least one support rib oriented substantially parallel to a longitudinal axis of the plate, wherein said plate insert is adapted to substantially correspond to one or more of a forefoot, midfoot and/or rearfoot of a wearer's foot.

22. The plate insert of claim 21, wherein the at least one support rib comprises a support rib on the lateral side and a support rib on the medial side.

23. The plate insert of claim 21, wherein the at least one support rib is disposed towards an edge of the plate.

24. The plate insert of claim 21, wherein the plate further comprises a reinforcing heel cage comprising a posting upwardly extending from the plate and configured to surround a portion of the side of a wearer's rearfoot when in use.

25. The plate insert of claim 21, further comprising a rearfoot portion that has an open channel adapted to correspond to a substantial area of a wearer's heel.

26. The plate insert of claim 25, further comprising a midsole portion disposed adjacent the rearfoot portion, the midsole portion having an open channel generally corresponding to the open channel in the rearfoot portion.

27. The plate insert of claim 21, wherein the elongate elements are substantially parallel to one another.

28. The plate insert of claim 21, wherein the elongate elements have substantially uniform widths along their lengths.

29. The plate insert of claim 21, comprising an elastomeric polymer.

30. The plate insert of claim 25, comprising a single piece of elastomeric polymer.

* * * * *